US005730202A

United States Patent [19]

Shimmell

[11] Patent Number: 5,730,202

[45] Date of Patent: Mar. 24, 1998

[54] CONSTANT VOLUME SHOT SLEEVE

[75] Inventor: Dennis S. Shimmell, Hudsonville, Mich.

[73] Assignee: Nelson Metal Products Corporation, Grandville, Mich.

[21] Appl. No.: 617,063

[22] Filed: Mar. 18, 1996

[51] Int. Cl.[6] ..... B22D 17/10; B22D 17/20

[52] U.S. Cl. ..... 164/113; 164/312

[58] Field of Search ..... 164/113, 312, 164/314

[56] References Cited

U.S. PATENT DOCUMENTS 5,199,480 4/1993 Schultz et al. ..... 164/312
5,205,338 4/1993 Shimmell ..... 164/113
5,375,646 12/1994 Stummer et al. ..... 164/113
5,529,110 6/1996 Shimmell ..... 164/113
5,601,136 2/1997 Shimmell ..... 164/113

*Primary Examiner*—Joseph J. Hail, III
*Assistant Examiner*—I.-H. Lin
*Attorney, Agent, or Firm*—Warner Norcross & Judd LLP

[57] ABSTRACT

A die casting shot sleeve having an overflow hole and an overflow valve for selectively opening and closing the overflow hole. The overflow hole extends through the shot sleeve at a level below the pour hole to allow molten material in excess of a predetermined volume to spill from the shot sleeve. When open, the overflow hole permits excess metal to spill from the shot sleeve. When closed, the metal can be expelled from the sleeve without additional material spilling through the overflow hole.

20 Claims, 2 Drawing Sheets

CONSTANT VOLUME SHOT SLEEVE

BACKGROUND OF THE INVENTION

The present invention relates to die casting equipment, and more particularly to a metal delivery shot sleeve through which molten metal is transferred into a die.

Die casting is a commonly used technology for fabricating a wide range of metal articles. Typically, two or more die parts are provided, each defining a void corresponding in shape to a portion of the article to be cast. When the die parts are brought together, these voids cooperate to define a die cavity in the shape of the article to be cast. Molten metal is introduced into the die cavity and allowed to cure—typically by cooling. Once the article is sufficiently cured, the die parts are opened and the cast article is removed. The die parts can be reclosed and the process repeated to cast the desired number of identical articles.

A conventional die casting apparatus is illustrated in FIG. 1, and generally designated 100. The die casting apparatus 100 includes a die assembly 108 that receives molten material from a shot sleeve assembly 110. The die assembly 108 includes a pair of die halves 102 and 104 each formed with a void. When the two die halves 102 and 104 are brought together, their respective voids cooperate to form a die cavity 106 corresponding to the shape of the article to be cast.

Molten metal is introduced into the die cavity 106 by means of the shot sleeve assembly 110, which includes a shot sleeve 112 defining an internal bore 114. The shot sleeve 112 extends into the die assembly 108 such that the internal bore 114 is in fluid communication with the die cavity 106. The shot sleeve 112 includes a pour hole 116 for introducing molten material into the shot sleeve. A plunger 118 reciprocates within the shot sleeve 112 to expel the molten metal from the internal bore 114 into the die cavity 106. The plunger 118 is connected to a hydraulic cylinder 120 by a plunger rod 122. Extension of the plunger 118 injects the molten metal within the sleeve 112 into the die cavity 106. Retraction of the plunger 118 withdraws the plunger 118 to permit the sleeve 112 to be refilled through the pour hole 116 for the next shot.

With recent advances in die casting techniques and process, it is import to ensure that a precise volume of metal is introduced into the shot sleeve for injection into the die. Delivery of precise volumes of metal enables the system designer to design and to consistently replicate proper position and character of the metal during the die casting operation. The long-accepted technique of simply ladling metal into the shot sleeve through a pour hole does not provide the precision require in many present day applications. Accordingly, the inventor of the present application has developed several techniques and approaches for filling a die casting shot sleeve with a precise volume of metal by matching the internal volume of the shot sleeve with the desired volume of material.

For example, U.S. Pat. No. 5,205,338 issued Apr. 27, 1993 to Shimmell discloses a system having a filling cylinder that intersects the shot sleeve and includes a reciprocating slide valve for sealing the shot sleeve. After the shot sleeve is filled with material and before the plunger is advanced, the slide valve is actuated to seal off the pour hole in the shot sleeve. The closed shot sleeve provides a constant volume shot that corresponds to the internal volume of the shot sleeve.

Another example, U.S. application Ser. No. 08/280,159 filed Jul. 25, 1994 by Shimmell discloses a shot sleeve with a rotary actuated collar about the pour hole. In a first position, the collar permits the sleeve to be filled. In a second position, the collar closes the completely filled sleeve in preparation for actuation of the plunger. Again, the sleeve provides a constant volume shot the corresponds to the internal volume of the shot sleeve.

Yet another example, U.S. patent application Ser. No. 08/468,256 filed Jun. 6, 1995 by Shimmell discloses a shot sleeve that is inclined downwardly from the pour hole. Molten metal is poured into the shot sleeve until it fills the shot sleeve up to the pour hole leaving only a small amount of air within the shot sleeve. As the plunger advances, the air in the sleeve is expelled through the pour hole. Because of the shape and disposition of the pour hole, the air completely expelled from the sleeve just as the pour hole is sealed by the plunger. The inclined shot sleeve provides a constant volume shot that corresponds to the internal volume of the shot sleeve forward of the pour hole.

While all of these constructions are reliable and effective, they require the shot sleeve to be completely filled with molten metal on each shot.

SUMMARY OF THE INVENTION

The aforementioned problems are overcome by the present invention wherein a shot sleeve includes an overflow hole and overflow valve for controlling the volume of molten material within the sleeve. The overflow hole extends through the wall of the shot sleeve allowing molten material to spill from the shot sleeve once it has reached a specific level corresponding to a specific volume. The overflow valve reciprocates within the overflow hole to selectively open and seal the hole.

In operation, the overflow valve is closed to seal the overflow hole before any molten material is introduced into the shot sleeve. Molten material is poured into the sleeve through the pour hole until the level of material is above the overflow hole. The overflow valve is then opened to allow excess material to spill out of the sleeve through the overflow hole. The valve is then closed to seal the overflow hole, and the plunger is advanced to inject the molten material into the die cavity.

The present invention provides a simple and effective shot sleeve system that is capable of providing a fixed-volume shot without the need to completely fill the shot sleeve prior to injection. Further, the present invention can operate as a conventional shot sleeve simply by maintaining the overflow valve in the closed position.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
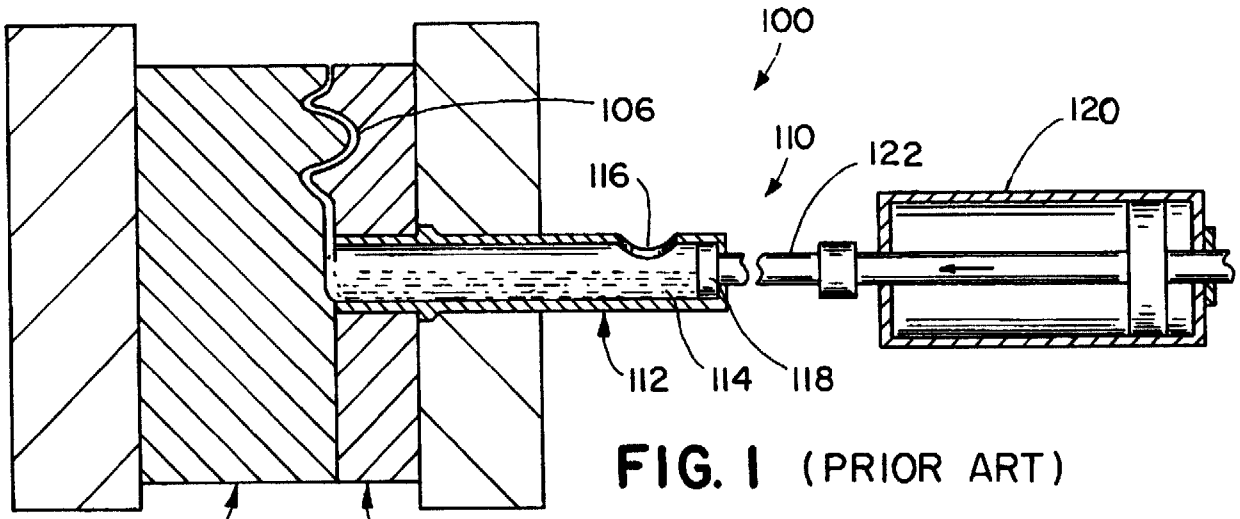
FIG. 1 (PRIOR ART)
FIG. 1 is a sectional, side elevational view of a die casting apparatus according to the prior art.
Figure 2:
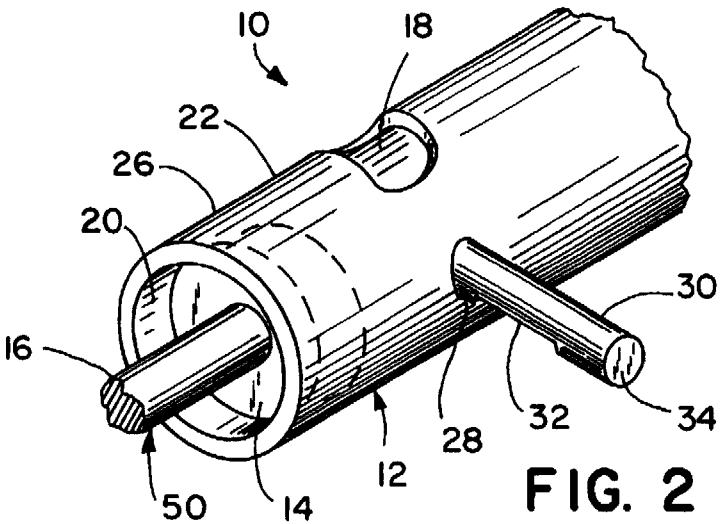
FIG. 2 is a perspective of a portion of the shot sleeve system of the present invention.

A shot sleeve system according to a preferred embodiment of the present invention is illustrated in FIG. 2, and generally designated 10. The shot sleeve system 10 is adapted for use with conventional die casting apparatus. FIG. 1 shows a prior art die casting apparatus 100 having a conventional die assembly 108 and a conventional shot sleeve system 110. The die assembly 108 defines a die cavity 106 in the shape of the article to be cast. The shot sleeve system 110 injects molten material into the die cavity 106 to create the cast article. The shot sleeve system 10 of the present invention is intended to replace the conventional shot sleeve system 110 shown in FIG. 1. The shot sleeve system 10 of the present invention is integrated into the die casting apparatus 100 by interconnecting the shot sleeve system 10 and die assembly 108 in the conventional manner shown in FIG. 1. Molten material is ladled into the shot sleeve system 10 and then forced into the die by a conventional plunger arrangement to create cast articles. While the present invention is described in connection with a conventional metal die casting apparatus, it is also well suited for use with other types of injection molding systems, including polymeric injection molding systems.

The shot sleeve system 10 includes a shot sleeve 12 that is generally cylindrical and includes a circumferential wall 22 defining a concentric internal bore 20. The shot sleeve 12 includes a die end (not shown) that is adapted to penetrate the die assembly in the same manner as the conventional shot sleeve 112 shown in FIG. 1, thereby permitting fluid communication between the internal bore 20 and the die cavity. The shot sleeve also includes a plunger end 26 that is open to receive plunger 14 as shown in FIG. 2. The shot sleeve 12 defines a generally circular pour hole 18 near plunger end 26. The pour hole 18 is in communication with internal bore 20 allowing molten metal to be ladled into the internal bore 20. The shot sleeve 12 also defines an overflow hole 28 for allowing molten metal in excess of a predetermined volume to spill from the internal bore 20. The overflow hole 28 is generally circular and extends entirely through circumferential wall 22 along a substantially horizontal axis. The overflow hole 28 is positioned proximate the plunger end 26 of the shot sleeve 12 so that it does not bear the high internal pressure generated within the shot sleeve 12 as the plunger 14 is advanced. The position and diameter of the overflow hole 28 will vary from application to application to control the volume of the shot sleeve 12.

Figure 3:
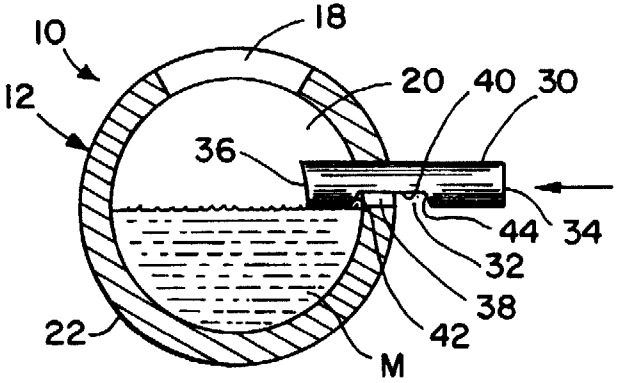
FIG. 3 is a sectional view of the shot sleeve showing the overflow hole in the open position.

The shot sleeve system 10 also includes an overflow valve 30 positioned within the overflow hole 28. The overflow valve 30 reciprocates to selectively open and close the overflow hole 28. The overflow valve 30 is connected to a conventional actuating mechanism (not shown) such as a hydraulic or pneumatic cylinder. The overflow valve 30 is generally cylindrical and includes inner and outer ends 34 and 36, respectively. The outer diameter of the overflow valve is slightly less than the inner diameter of the overflow hole 28. Narrow tolerances between the hole 28 and valve 30 prevent die cast metal from seeping out the sleeve around the closed valve. A recess 32 is defined along the bottom center of the overflow valve 30. The recess 32 is defined by top wall 40 and opposed side walls 42 and 44. The recess 32 provides a flow path 38 for molten metal to spill from the sleeve 12 when the valve is in the open position (See FIG. 3). The opposed side walls 42 and 44 are obtuse to the top wall 40 to increase the cross sectional area of opposite ends of flow path 38. Additionally, the inner end 36 of the valve 30 is concave to match the contour of the inside surface of the circumferential wall 22 when the valve is in the closed position (See FIG. 4). This allows the plunger 14 to reciprocate without interference from the valve 30. While the presently preferred overflow hole 28 and overflow valve 30 are circular in cross section, they can vary in cross section as desired.

As noted above, the shot sleeve system 10 includes a conventional plunger arrangement 50 for forcing the molten metal from the shot sleeve 12 into the die cavity (not shown). The plunger arrangement 50 includes a plunger 14 seated within the internal bore 20, a plunger rod 16 connected to the plunger 14, and a hydraulic cylinder (not shown) for reciprocating the plunger rod 16, and consequently the plunger 14, within the internal bore 20. The plunger rod 16 extends from the hydraulic cylinder (not shown) to the plunger 14 through the plunger end 26 of the shot sleeve 12. When the hydraulic cylinder is extended, the plunger rod 16 pushes the plunger 14 forward into the internal bore 20 of .the shot sleeve 12 forcing molten material out of the shot sleeve 12 into the die cavity. When the hydraulic cylinder is retracted, the plunger rod 16 pulls the plunger 14 back toward the plunger end 26 of the shot sleeve 12.

Operation

Initially, the die assembly is prepared for casting in a conventional manner. Generally, the die halves are closed to define a die cavity in the shape of the desired cast article. In addition, the plunger 14 is fully retracted by operation of the hydraulic cylinder (not shown), and the overflow valve 30 is closed by operation of a conventional actuating mechanism (not shown). The overflow valve 30 is closed by positioning it within the overflow hole such that it fills the overflow hole 28 eliminating flow path 38. At this point, the shot sleeve 12 is ready to receive molten metal.

Figure 4:
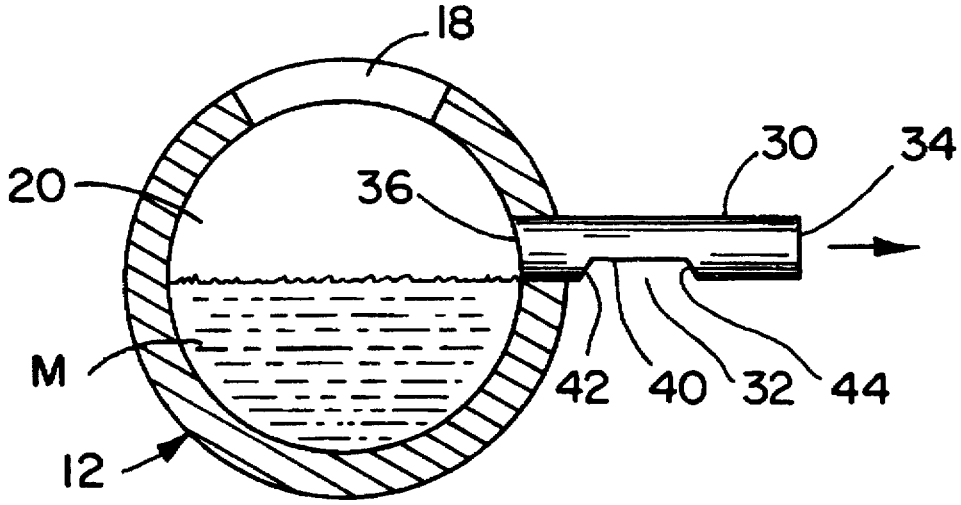
FIG. 4 is a sectional view of the shot sleeve showing the overflow hole in the closed position.

Molten metal M is ladled into the shot sleeve 12 through pour hole 18 until the internal bore 20 is filled above the height of the overflow hole 28. Once the shot sleeve 12 is sufficiently filled, a slight rest period is provided to allow the molten metal M to level. Then, the overflow valve 30 is opened by moving it into the shot sleeve 12 until recess 32 bridges the circumferential wall 22 to define flow path 38 (See FIG. 3). This permits molten metal to spill from the sleeve 12 through flow path 38 until the level of metal in sleeve 12 reaches the bottom of the overflow hole 28. A receptacle (not shown) can be positioned to catch molten metal spilling out of the overflow hole 28 for reuse. After the excess metal has spilled from the shot sleeve 12, the overflow valve 30 is closed by operation of the actuating mechanism. As shown in FIG. 4, the overflow valve 30 is closed by moving it outward until the overflow hole 28 is sealed and the inner end 36 of the valve 30 is aligned with the inner surface of the circumferential wall 22. At this point, molten metal M will fill internal bore 20 up to the bottom of overflow hole 28.

Next, the plunger 14 is advanced by operation of the hydraulic cylinder. As the plunger advances, it forces the molten metal M from the internal bore 20 into the die cavity (not shown). Once the plunger 14 is fully extended, the molten metal M is allowed to cure. Optionally, high pressure may be developed in the molten metal for squeeze casting.

After the article is sufficiently cured, the plunger 14 is retracted by operation of the hydraulic cylinder and the die assembly is opened to remove the cast article. The empty die assembly is then closed to prepare the system for the next shot.

Alternative Embodiment

Figure 5:
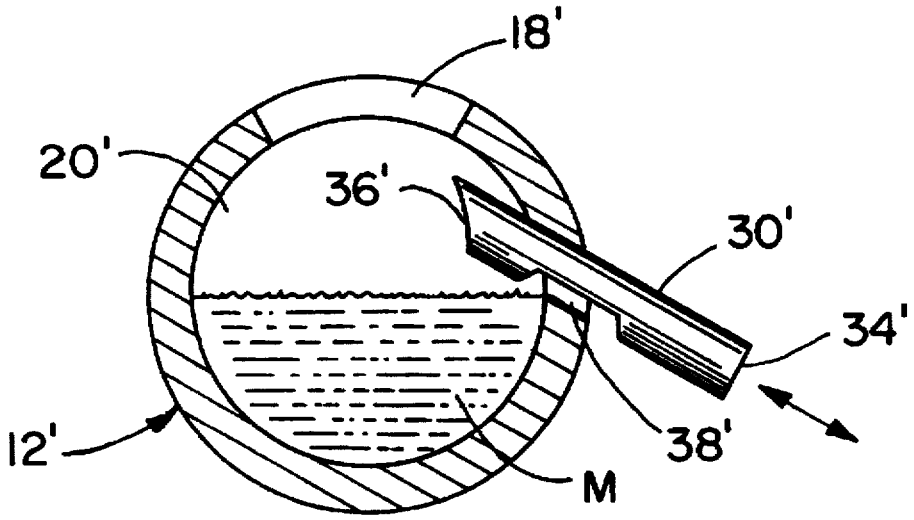
FIG. 5 is a sectional view of an alternative shot sleeve with an alternative overflow hole in the open position.

An alternative embodiment of the present invention is illustrated in FIG. 5. In this embodiment, the overflow hole 28' extends through the circumferential wall 22' of the shot sleeve 12' along an axis skewed approximately 40 degrees from horizontal. Likewise, the overflow valve 30' is mounted for reciprocal movement parallel to the axis of the overflow hole 28'. When opened, the angled overflow valve 30 provides a relatively open flow path 38' that is not obstructed by the inner end 36 of the valve.

The above descriptions are those of preferred embodiments of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A shot sleeve system for a die casting apparatus comprising:

a shot sleeve having a circumferential wall defining an internal bore and an overflow hole;

a plunger means for ejecting molten material from said shot sleeve, said plunger means mounted for reciprocal movement within said internal bore;

an overflow valve movable between an open position in which said internal bore is in external communication through said overflow hole and a closed position in which said overflow valve closes said overflow hole; and an actuating means for moving said overflow valve between said open position and said closed position.

2. The shot sleeve system of claim 1 wherein said overflow valve includes a first portion corresponding in cross section to said overflow hole and a second portion having a cross sectional area less than that of said overflow hole, said valve being movable in a linear direction between (a) an open position in which said second portion bridges said circumferential wall to define a flow path and (b) a closed position in which said first portion is positioned within said overflow hole to seal said overflow hole.

3. The shot sleeve system of claim 2 wherein said circumferential wall includes an inner surface having a contour, said overflow valve including an inner end shaped to match said contour of said inner surface, said inner end aligning with said inner surface when said overflow valve is in said closed position.

4. The shot sleeve system of claim 3 wherein said overflow hole is circular in cross section and said first portion of said valve is circular in cross section.

5. The shot sleeve system of claim 4 wherein said overflow valve includes a bottom, said second portion defining a recess extending longitudinally along said bottom of said valve.

6. The shot sleeve system of claim 5 wherein said recess is defined by a top wall and a pair of opposed side walls, said side walls being obtuse to said top wall.

7. The shot sleeve of claim 6 wherein said overflow hole extends along a generally horizontal axis.

8. The shot sleeve of claim 6 wherein said overflow hole extends along an axis skewed upwardly toward said internal bore.

9. A shot sleeve for delivering molten material to a die cavity comprising:

a circumferential wall defining an internal bore and a pour hole communicating with said bore, said circumferential wall further defining an overflow hole extending entirely through said wall, said overflow hole positioned below said pour hole;

an overflow valve at least partially mounted within said overflow hole for selective linear movement between a closed position in which said valve seals said overflow hole and an open position in which said overflow hole remains open such that said internal bore is in external communication via said overflow hole; and an actuating means for selectively moving said overflow valve between said open position and said closed position.

10. The shot sleeve of claim 9 wherein said overflow valve includes a first portion corresponding in cross section to said overflow hole and a second portion having a cross sectional area less than that of said overflow hole, said valve being movable in a linear direction between (a) an open position in which said second portion bridges said circumferential wall to define a flow path and (b) a closed position in which said first portion is positioned within said overflow hole to close and seal said overflow hole.

11. The shot sleeve of claim 10 wherein said circumferential wall includes an inner surface having a contour, said overflow valve including an inner end shaped to match said contour of said inner surface, said inner end aligning with said inner surface when said overflow valve is in said closed position.

12. The shot sleeve of claim 11 wherein said overflow hole is circular in cross section and said first portion of said valve is circular in cross section.

13. The shot sleeve of claim 12 wherein said overflow valve includes a bottom, said second portion defining a recess extending longitudinally along said bottom of said valve.

14. The shot sleeve of claim 13 wherein said recess is defined by a top wall and a pair of opposed side walls, said side walls being obtuse to said top wall.

15. The shot sleeve of claim 14 wherein said shot sleeve includes a plunger end and said overflow hole is proximate said plunger end.

16. A die casting apparatus comprising:

a die assembly having a plurality of die elements that cooperate to define a die cavity;

a shot sleeve mounted to said die assembly, said shot sleeve defining an internal bore in communication with said die cavity and including an overflow means for allowing molten material to spill from said shot sleeve once a desired volume of molten material is contained within said shot sleeve, said overflow means communicating with said internal bore;

an overflow valve means for selectively opening and closing said overflow means to selectively prevent molten material from spilling from said shot sleeve via said overflow means; and a plunger means for ejecting molten material from said shot sleeve into said die cavity, said plunger means mounted for reciprocal movement within said internal bore of said shot sleeve.

17. A method for die casting comprising:

retracting a plunger from a shot sleeve;

introducing molten material into the shot sleeve through a pour hole until the molten metal is above an overflow hole in the side of the sleeve;

permitting excess material to spill from the sleeve through the overflow hole;

closing the overflow bole with an overflow valve; and advancing the plunger within the shot sleeve to eject the molten material from the shot sleeve.

18. The method of claim 17 further comprising the steps of:

closing the overflow valve prior to said introducing step;

waiting a predetermined period of time for the molten material to level after said introducing step; and opening the overflow valve between said waiting and said permitting steps.

19. The method of claim 18 wherein the overflow valve includes a first portion corresponding in cross section to the overflow hole and a second portion having a cross sectional area less than that of the overflow hole;

said closing step being defined as moving the overflow valve such that the second portion bridges the circumferential wall to define a flow path; and said opening step being defined as moving the overflow valve such that the first portion is positioned within the overflow hole to seal the overflow hole.

20. A die casting apparatus comprising:

a shot sleeve defining a pour hole and an overflow hole, said pour hole being at a higher level than said overflow hole;

a plunger reciprocable within said sleeve; and valve means for selectively opening and closing said overflow hole.

* * * * *

UNITED STATES PATENT AND TRADEMARK OFFICE

CERTIFICATE OF CORRECTION

PATENT NO. : 5,730,202

DATED : March 24, 1998

INVENTOR(S) : Dennis S. Shimmell

It is certified that error appears in the above-indentified patent and that said Letters Patent is hereby corrected as shown below:

Column 6, Claim 17, Line 61:
"bole" should be --hole--

Signed and Sealed this

Fourteenth Day of July, 1998

Bruce Lehman

*Attest:*

BRUCE LEHMAN

*Attesting Officer*

*Commissioner of Patents and Trademarks*